US006358067B1

(12) United States Patent
Takase et al.

(10) Patent No.: US 6,358,067 B1
(45) Date of Patent: Mar. 19, 2002

(54) DOCKING-STYLE INTERMEDIATE CONNECTOR

(75) Inventors: Hisato Takase, Machida; Yoshikazu Ito, Yamato; Masanori Yagi, Ebina, all of (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/381,179

(22) PCT Filed: Jan. 15, 1999

(86) PCT No.: PCT/US99/00186

§ 371 Date: Jan. 31, 2000

§ 102(e) Date: Jan. 31, 2000

(87) PCT Pub. No.: WO99/36995

PCT Pub. Date: Jul. 22, 1999

(30) Foreign Application Priority Data

Jan. 16, 1998 (JP) ..... 10-20458
Sep. 11, 1998 (JP) ..... 10-26227

(51) Int. Cl.[7] ..... H01R 12/00
(52) U.S. Cl. ..... 439/79; 439/541.5
(58) Field of Search ..... 439/79, 80, 541.5, 439/608, 352

(56) References Cited

U.S. PATENT DOCUMENTS 5,044,975 A * 9/1991 DiBene, II et al. ..... 439/352
5,055,069 A * 10/1991 Townsend et al. ..... 439/608
5,603,634 A * 2/1997 Ichikawa et al. ..... 439/404
5,636,999 A * 6/1997 Hirai et al. ..... 439/79
5,647,749 A * 7/1997 Atoh et al. ..... 439/79
5,688,130 A * 11/1997 Huang ..... 439/79
6,059,600 A * 9/2000 Vanbesian ..... 439/378

* cited by examiner

*Primary Examiner*—Tulsidas Patel
(74) *Attorney, Agent, or Firm*—Thomas D. Paulius; Charles S. Cohen

(57) ABSTRACT

An intermediate connector for engaging a surface mount connector and a cable connector contains conductive terminals in a body portion. The body portion is cooperatively defined by distinct and separate terminal contact support portions that are affixed to opposite ends of the connector terminals. The support portions may be affixed to the connector terminals from different directions and thus eliminates the need for a complex, molded connector housing. The support portions and the terminals are held together and aligned together by a retainer and a spacer is provided to maintain a desired spacing between the terminals of the connector.

17 Claims, 5 Drawing Sheets

DOCKING-STYLE INTERMEDIATE CONNECTOR

BACKGROUND OF THE INVENTION

The present invention relates generally to docking-style connector assemblies that mount to circuit boards, and more particularly, to intermediate connector used as part of an overall docking-style connector assembly for connecting a multi-wire cable connector, such as an input/output ("I/O") connector to circuits on a circuit board along an edge portion of the circuit board.

Docking-style connector assemblies are used often in computer applications for providing a connection between circuits on a computer circuit board and a peripheral device, such as a printer, disk drive, etc. In order to provide a connection to the circuits on the circuit board, conventional surface mount connectors are used. These surface mount connectors include an electrically insulative housing with a plurality of conductive terminals loaded within the connector housing. Solder tails are formed on the terminals, and extend out of the connector housing so that they may be soldered to conductive pads arranged on the circuit board. The solder tails are soldered to the surface of the circuit board by either the reflow or the solder dipping method where the surface mount connector terminals extend through holes formed in the circuit board. Where a through hole manner of mounting is used, the through holes on the opposite side of the circuit board take up valuable space on the circuit board that could otherwise be used for accommodating circuitry and components.

These surface mount connectors are mateable with other connectors. The surface mount connectors are usually oriented with their engagement portions being of a straight-type engagement that are oriented upwardly, or a right angle-type engagement that is oriented parallel to the circuit board. When the number of terminals is increased and the connector size remains the same, the pitch of the terminals must be decreased accordingly. Surface soldering is frequently used in such applications, and the solder tails of the connector are arranged on two opposing sides of the connector housing.

In this type of structure, the right angle-type engagement portion of the surface mount connectors have terminals that extend out from the rear side of the connector. These terminals must have a longer length as compared to the terminals arranged on the front side of the connector, thereby causing difficulty in maintaining a predetermined pitch of the solder tails extending out of the front side of the connector.

Furthermore, the ends of the solder tails are exposed around the engagement end of an opposing cable connector which potentially may cause difficulty in engaging the cable connector on the wire side, or the cable connector may unexpectedly impact upon and cause damage to the solder tail ends. Additionally, the coupling of a cable connector to the surface mount connector may exert forces on the soldered ends of the solder tail portions during engagement, and these forces may cause breakage of the soldered portion.

Additionally, where through hole surface mount connectors are used, the through holes formed in the circuit board prevent the use of a surface mount, or any other style connector, on the opposite side of the circuit board. Thus, this type of arrangement wastes space on the circuit board and accordingly, is not good for use in docking type applications as will be found in notebook and laptop computers.

Docking-style connector assemblies require a set of terminal contacts be oriented in a direction parallel to the circuit board so as to protrude through a housing of the computer. This may be accomplished by using an intermediate connector that engages the surface mount connector and has an engagement portion that projects in the desired direction. The terminals in these intermediate connectors must be bent or angled in order to make contact with the terminals of the surface mount connector and also make contact, on the opposing end of the intermediate connector, with the terminals of an opposing connector. Such connectors may be formed by first bending a set of terminals to their desired shapes and then inserting the terminals into openings in a pre-formed connector housing. It is expensive to form and mold such a connector housing because of the different directions that the terminals take in their path between two ends of the connector housing. The forming of these openings is a complex and delicate procedure and increases the cost of manufacturing such intermediate connectors.

SUMMARY OF THE INVENTION

The present invention is directed to an intermediate connector having a construction that overcomes the aforementioned disadvantages.

Therefore, it is a general object of the present invention to provide an intermediate connector for use in a docking-style connector assembly and for mounting near the edge of a circuit in which the intermediate connector housing is formed from a plurality of separate parts, that eliminates the need for complex molded connector housings.

It is another object of the present invention to provide an improved docking-style connector assembly for mounting on an edge of a circuit board, the assembly having a right-angle intermediate connector that is vertically aligned with the surface mount connector, the intermediate connector having a connector body portion with an internal cavity that encloses a plurality of terminals, each of the terminals having first and second contact portions disposed at opposite ends thereof, the connector body having separate and distinct terminal support portions that cooperatively form the connector body portion and which respectively support the terminal first and second contact portions.

Still another object of the present invention is to provide a surface mount connector assembly for mounting to a circuit board near an edge thereof, the connector assembly having a right-angled body portion that extends above the circuit board and over the edge of the circuit board, the right-angled body portion having a plurality of terminals with first contact portions supported at one end of the body portion and positioned past the edge of the circuit board and away from the circuit board for engaging with an opposing docking-style connector, the terminals further having second contact portions supported at another end of the body portion above and directed at the circuit board, the body portion having an open, internal cavity that reduces the amount of material needed for forming the intermediate connector.

Yet another object of the present invention is to provide an intermediate connector for use in docking-type applications to provide a connection between a surface mount connector mounted to a circuit board and an opposing cable connector, the intermediate connector having a connector body that houses a plurality of conductive terminals disposed therein and extending between two contact ends of the connector body, one of the contact ends including a dual row leaf connector portion that supports a plurality of first contact portions of the intermediate connector terminals and positions them to engage the opposing cable connector, the other of the contact ends including a plug-type connector portion that supports a plurality of second contact portions of the intermediate connector terminals in a position to engage an opposing receptacle-type surface mount connector mounted to a circuit board.

In order to accomplish these and other objects, the present invention, in one principal aspect, provides an intermediate connector assembly for engaging a surface mount connector near an edge portion of a circuit board and for engaging a multi-wire cable connector at a location past the edge of the circuit board. The intermediate connector includes a connector housing that includes a dual row leaf connector portion that extends past the edge of the circuit board and supports a plurality of conductive terminal first contact portions in position for mating with opposing terminals of the cable connector. The connector housing also includes a plug-style connector portion spaced apart from and oriented in a different direction from the dual row leaf connector portion that mates with the surface mount connector mounted on the circuit board. This plug-style connector portion supports a plurality of conductive terminal second contact portions in position for mating with opposing terminals of the surface mount connector.

In another principal aspect of the present invention, the intermediate connector housing is cooperatively formed by a plurality of connector housing elements. Such elements include the dual row leaf connector portion and the plug-style connector portion. These separate portions include terminal-receiving openings so that each separate portion may be affixed to the terminal first and second contact portions from different directions. This eliminates the need for a complex, molded connector housing.

In another principal aspect of the present invention, the intermediate connector housing portions are held together by a retention member, that takes the form of a bracket in the preferred embodiment. The retention bracket assists in aligning the separate portions together and also providing support for the guide pins of the intermediate connector that are used to guide the opposing cable connector into engagement with the intermediate connector.

The intermediate connector may also be fixed to the circuit board by mounting screws that extend through holes in both the circuit board and the intermediate connector. In this manner, the surface mount connectors may be respectively mounted on opposing front and back (top and bottom) surfaces of the circuit board, and a pair of intermediate connectors may respectively engage these surface mount connectors and also be fixed to the circuit board.

Because the intermediate connector may be directly fixed to the circuit board by these screws, forces developed during engagement of a cable connector to the intermediate connector are directly transmitted to the circuit board and not to the surface mount connector or the solder tails thereof which might result in breaking the attachment of the surface mount connector to the circuit board.

In another principal aspect of the present invention, the intermediate connector includes a dual row leaf connector end that enclose and supports a plurality of conductive terminals in an orientation to mate with an opposing, docking-type connector. This end is positioned above the circuit board and past an edge of the circuit board so that it may be mated with a docking-style connector, such as a multi-wire connector. The dual row leaf connector end and its terminals extend horizontally past the edge of the circuit board.

These and other objects, features and advantages of the present invention will become apparent from the following detailed description, taken in conjunction with the accompanying drawings.

BRIEF DESCRIPTION OF THE DRAWINGS

In the course of the following description of the detailed description, reference will be made to the attached drawings wherein like reference numerals identify like parts and wherein.

DETAILED DESCRIPTION OF THE PREFERRED EMBODIMENTS

Figure 1:
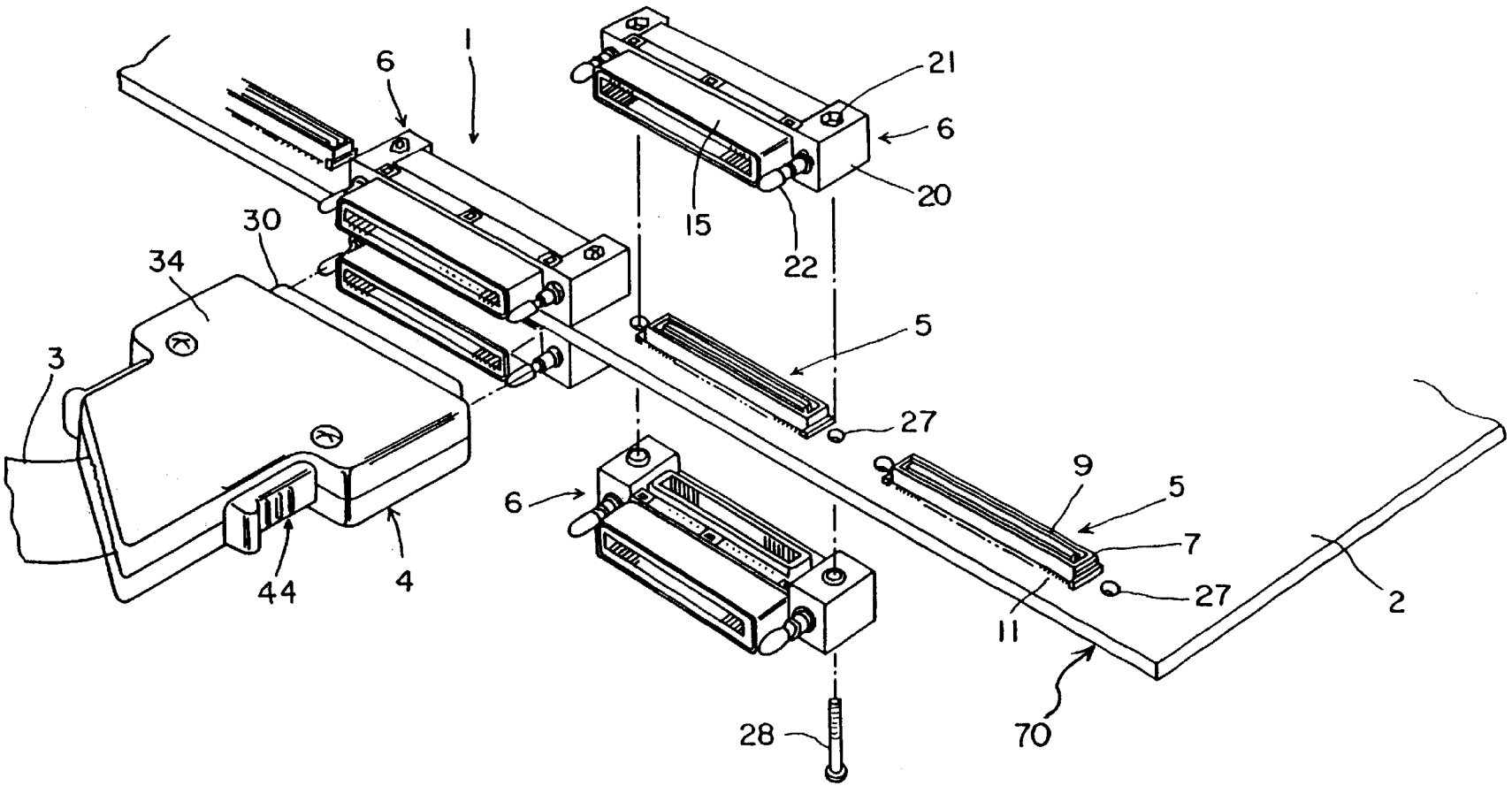
FIG. 1 is an exploded perspective view of a surface mount connector assembly utilizing a preferred embodiment of an intermediate connector constructed in accordance with the principles of the present invention, and which illustrates the manner of mounting of the intermediate connector on a circuit board for providing an I/O type of connection.

FIG. 1 is a perspective view of a surface mount connector assembly, generally indicated at 1, that provide a connection between circuits disposed on a circuit board 2 and a series of wires enclosed in a cable 3 and terminated to a wire connector, such as the I/O style connector 4 illustrated. An intervening intermediate connector 6, constructed in accordance with the principles of the present invention is used to connect the surface mount connector 5 to the cable connector 4.

Two manners of mounting the surface connector assembly 1 to a printed circuit board 2, and engaging a cable connector 4 connected to one end of a wire cable 3 to the surface connector assembly 1 are illustrated. In one manner, such as that shown in the lower right of FIG. 1, a single surface mount connector 5 is mounted to the circuit board 2 and hence will only mate with a single intermediate connector 6. In the other manner, as shown in the upper left of FIG. 1, two surface mount connectors 5 are attached to opposing surfaces of the circuit board 2, and two intermediate connectors 6 are mated thereto. Each intermediate connector 6 is mateable with an opposing cable connector 4 and acts as a right-angle connector in the embodiments shown in order to provide a point of connection to the cable connector 4, or other-style docking connector, that is located past the edge 70 of the circuit board 2.

The surface mount connector assembly 1 includes the surface mount connector 5 mounted to a surface of the printed circuit board 2 and an engaging, intermediate connector 6 that engages with the upper portion of the surface connector 5.

Figure 2:
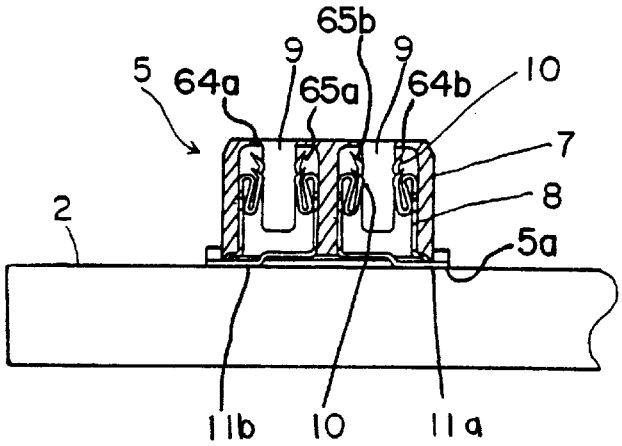
FIG. 2 is a cross-sectional view of the surface mount connector illustrated in FIG. 1.
Figure 3:
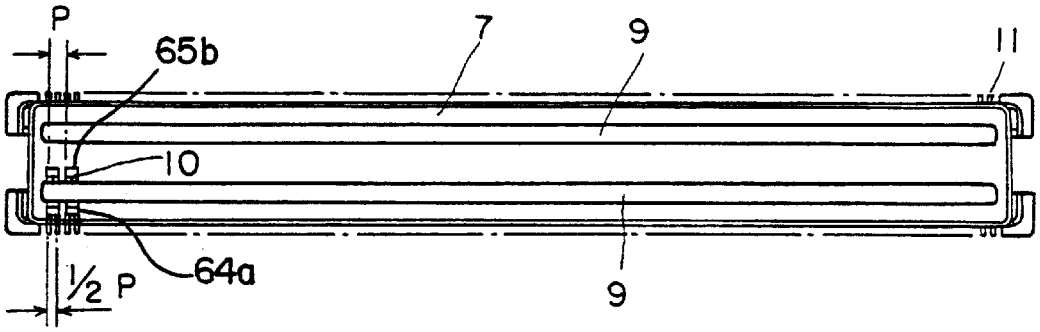
FIG. 3 is a top plan view of the surface mount connector illustrated in FIG. 1.

As shown best in FIGS. 2 & 3, the surface mount connector 5 can be seen to include a connector housing 7 formed from an electrically insulative material and a plurality of conductive terminals 8 that are mounted in the connector housing 7 at a predetermined pitch P. The connector housing 7 is shown as generally rectangular that may include a pair of slots 9 formed therein and opening to the upper surface of the connector housing 7 so as to form a receptacle connector.

Figure 4:
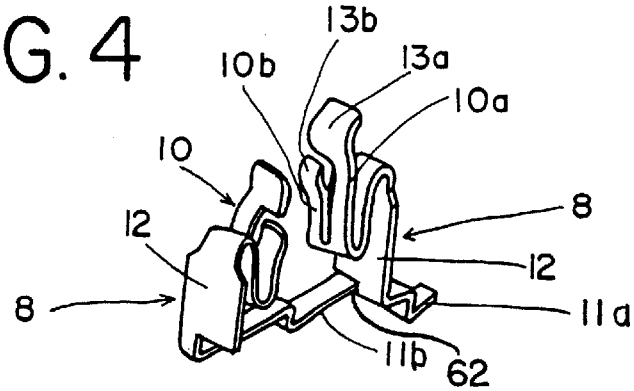
FIG. 4 is a perspective view of a pair of terminals utilized in the surface mount connector of FIGS. 1 and 2 arranged in an opposing pair of terminals.

The terminals 8 are mounted in the connector housing 2 longitudinally in a predetermined pitch P with respective contact portions 10 of the terminals mutually opposing each other on opposite sides of the slots 9. (FIG. 2.) The terminals 8 are arranged in two rows having aligned terminals, as shown in FIG. 4. Two sets of terminals 8 are shown in FIGS. 2 and 3 as mounted in two distinct rows 64*a*, 65*a* and 64*b*, 65*b* in each slot 9. It can be seen that the terminals 8 each have solder tail portions 11 that project along the bottom surface of the connector housing 7 in a manner such that they lie substantially flush with the connector housing bottom surface.

The solder tail portions 11 of the two rows of terminals 8 arranged in one slot 9 project out from one side of the connector housing, while the solder tail portions 11 of the rows of terminals 8 of the other slot 9 project out from the other and opposite side of the connector housing 7. In this relationship, the solder tails 11*a* of the terminals 8*a*, the contact portions 10*a* of which line the first of the two engagement slots 9*a* extend to one side (the right side as seen in FIG. 2) of the connector housing 7, while the solder tails 11*b* of the terminals 8*b* in which the contact pieces 10*b* thereof line the other of the two engagement slots 9*b* extend to the other and opposite side (shown as the left side in FIG. 2) of the connector housing 7.

Turning now to FIG. 4, a pair of opposed terminals of the connector 5 are illustrated in the position they take of two rows in each of the slots 9. Each such terminal can be seen to include a terminal body portion 12, a pair of contact portions 13*a*, 13*b*, and an associated solder tail portion 11. In order to allow the solder tails 11 to be located in the manner set forth above, the solder tails 11 of the respective terminals 8 has approximately half width of that of a corresponding opposing terminal body portion 12, such that the solder tails 11 of one row of terminals 8 in one slot 9 extend out of the connector housing 7, but underneath the terminal body portion 12 of the respective terminals 8 of the other row of terminals disposed in the same slot 9. This passing is facilitated by way of a recess, or cavity, 62 formed in the rightmost terminal body portion 12. As a result, it can be seen that the pitch of the solder tails 11 is one-half that of the pitch P of the terminals 8, i.e., ½–P.

The contact portions 10 of the terminals 8 are formed in a characteristic configuration and they each include two divided contact portions 10*a*, 10*b* that preferably extend parallel to each other. One of the divided contact portions 10*a* is longer than the other of the two divided contact portions 10*b*, so that arc-shaped contact portions 13*a*, 13*b* that are provided at the distal ends of the respective divided contact portions 10*a*, 10*b* are aligned along the longitudinal direction of the contact portion 10, i.e. vertically. As seen in FIG. 2, these contact portions 13*a*, 13*b* protrude slightly into the connector housing engagement slots 9.

In assembling the surface mount connector assembly 1, to the edge portion of the printed circuit board 2, the surface mount connector 5 is first mounted to the surface of the circuit board 2, near an edge portion 70 of the circuit board 2 as shown near side of FIG. 1. The solder tail portions 11 of the connector 5 project outwardly from the connector housing 7 along the sides of the connector housing 7 (or what may be considered as forward and rearward when viewing FIG. 1). The solder tail portions 11 are aligned in opposition to conductive pads (not shown) formed on the surface of the circuit board 2. The solder tail portions 11 and the conductive pads are then surface soldered by any desirable manner of soldering, such as by reflow soldering, in order to fix the connector 5 to the circuit board 2. The pitch of the solder tail portions 11 is one-half of the pitch P of the terminal contact portions 10, and thereby reduces the area occupied by the connector 5 and its solder tail portions 11. Thus, a high density connection may be achieved with the circuit board 2 while using a reduced amount of space thereon.

The surface mount connector 5 is of simple construction which basically includes the connector housing 7 and the plurality of conductive terminals 8. The solder tails 11 are also formed in a simple exterior configuration that extends outwardly along the bottom surface of the connector housing 7 exterior of the connector housing 7. This structure prevents the solder tail portions 11 from being excessively longer, and facilitates the manufacturing of the solder tail portions 11 of the terminals 8. It is also easy to maintain the arrangement pitch of the solder tails 11 in correspondence with a predetermined pitch P, and enable the surface soldering of the solder tail portions 11 to the circuit board 2 by a normal soldering reflow method.

Returning now to FIG. 1, it can be seen that the intermediate connector 6 is provided as part of the overall surface mount assembly 1 in order to provide an intervening connection between the surface mount connector 5 and a counterpart cable connector that encloses a plurality of terminated wires, such as is the case with input/output ("I/O") style connectors. This intermediate connector 6 includes a connector body portion 16 that provides an interior path for a set of conductive terminals 17 that extend between two different engagement portions 14, 15 to thereby permit the connector 6 to provide the necessary connection between the surface mount connector 5 and the cable connector. The connector body portion 16 is cooperatively formed by a series of distinct parts 14, 15, 65 and 66 that reduce its cost and simplify its assembly.

Figure 8:
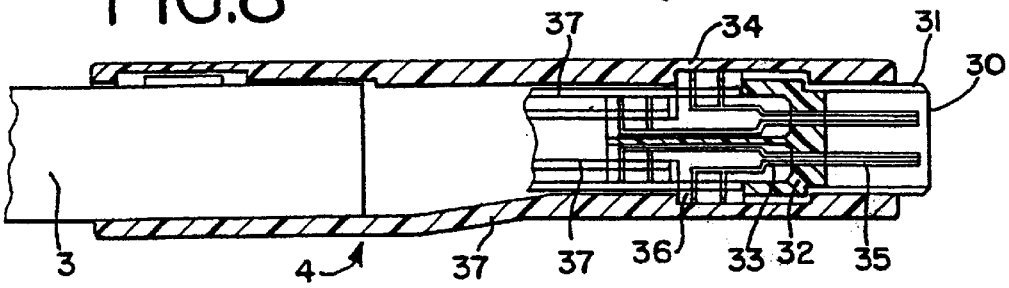
FIG. 8 is a longitudinal cross-sectional view of an exterior, cable connector used in the connector assembly of FIG. 1 that is intended to be connected to the projecting portion of the intermediate connector of FIG. 5.
Figure 9:
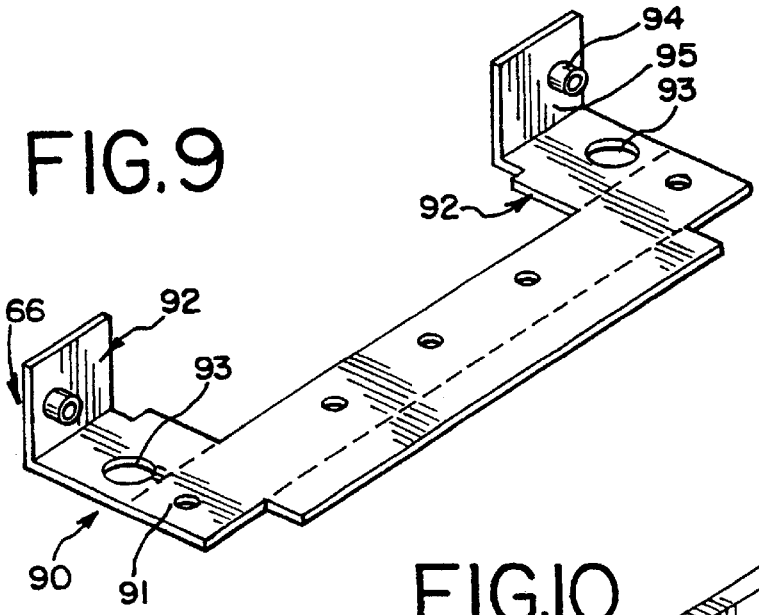
FIG. 9 is a perspective view of a retainer, partially formed, that is used with the intermediate connector of FIG. 5.

The first engagement part includes a dual row leaf connector housing 15 that supports thereon, the terminals 17, and particularly the first contact portions 19 thereof. these first contact portions 19 will engage and mate with opposing contact portions 35 of the cable connector 4, shown in FIGS. 1 and 8. The first connector housing 15 supports the terminals 17 and their first contact portions 19 generally parallel to the surface of the circuit board 2 and in an orientation that is past the edge 70 of the circuit board 2. The dual row leaf connector housing 15 further supports and arranges the terminals 17 in two distinct sets of terminals (shown in FIG. 5 as top and bottom sets), wherein each set has two opposing rows of terminals 17.

At the other engagement end of the intermediate connector 6, a second engagement part in the form of a second connector housing 14, is provided. This second housing 14, also supports the terminals 17 in the connector 6, and particularly supports opposing ends thereof and the second contact portion 18 thereof. The terminals 17 are bent so as to effect the benefits expected from a right-angle connector. The second housing 14 engages the upper portion of the surface mount connector 5 and thus includes a pair of plug portions 60 (FIG. 13) that are positioned within an interior cavity 61 thereof that is dimensioned to substantially receive the entire connector housing 7 of the surface mount connector 5 therewithin. The two plug portions 60 support the terminal second contact portions 18 in two rows of pairs of contact portions 18 that engage the two rows of pairs of contact portions 13 of the surface mount connector 5. The second contact portions 18 are provided at ends of the terminals 17 and extend a sufficient distance to project into the second housing 14 and its cavity 61. the second contact portions 18 project along the plug portions 60 and serve to define an overall plug end of the intermediate connector 6 that engages opposing contact portions 10 of the surface mount connector terminals 8 arranged in the receptacles 9 of the surface mount connector 5.

Figure 5:
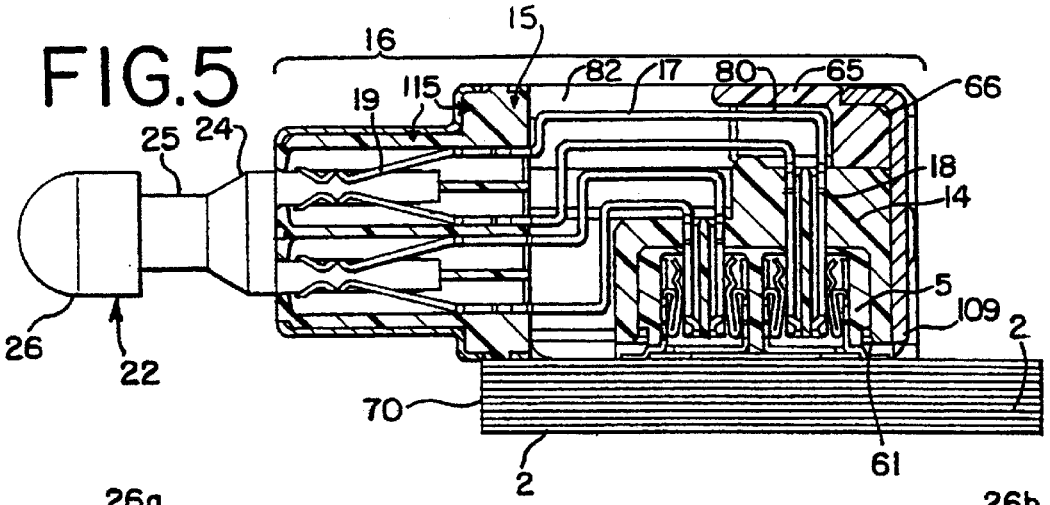
FIG. 5 is a cross-sectional view of an intermediate connector of FIG. 1 mated with an opposing surface mount connector fixed to a circuit board.
Figure 12:
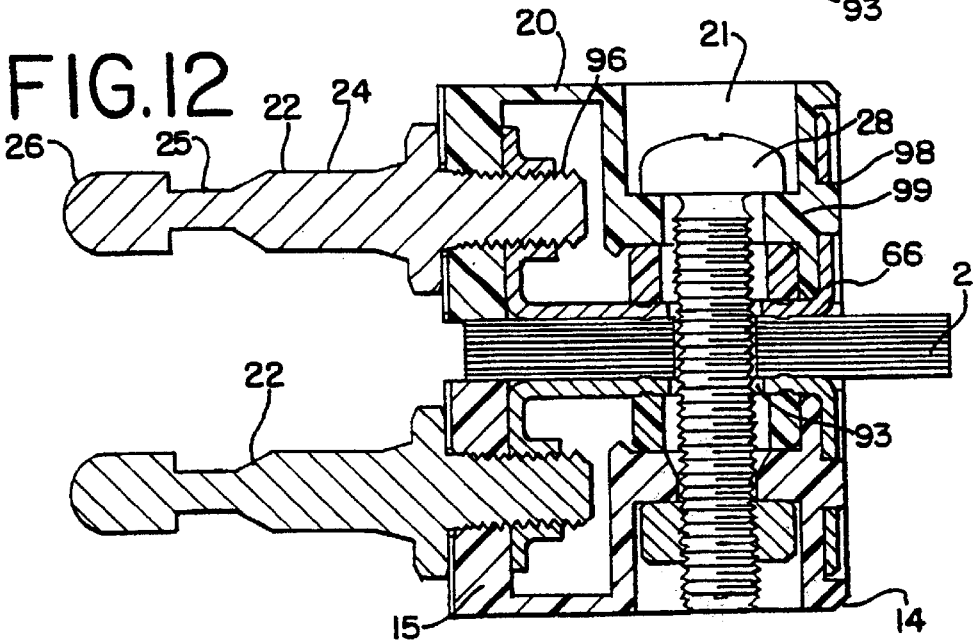
FIG. 12 is a cross-sectional view taken along lines 12—12 of FIG. 1, through the mounting portions of a pair of intermediate connectors mounted on opposite sides of a circuit board.

The cavity 61 is further dimensioned so that the bottom surface 16*a* of the intermediate connector body portion 16 will substantially abut the circuit board 2 as shown in FIGS. 5 and 12. The terminals 17 of the intermediate connector 6 are mounted with the same arrangement pitch P as the contact portions 10 of the surface mount connector terminals 8, and likewise form two sets of terminals corresponding to the two rows of terminals 8 in the two engagement slots 9 of the surface mount connector 5.

Figure 6:
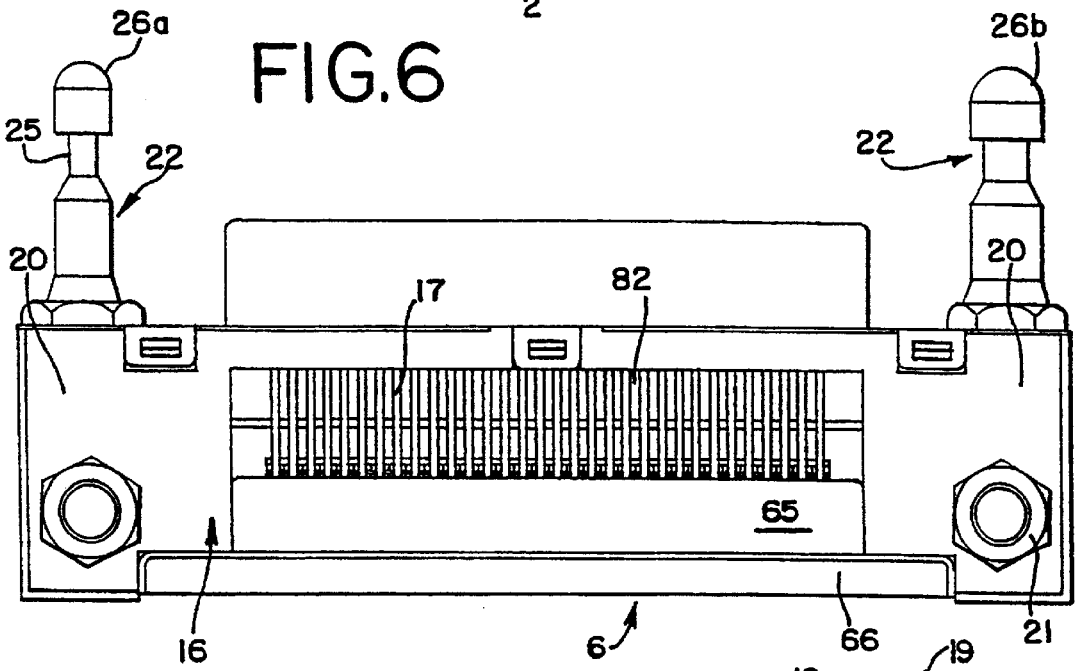
FIG. 6 is a top plan view of the intermediate connector of FIG. 5.
Figure 7:
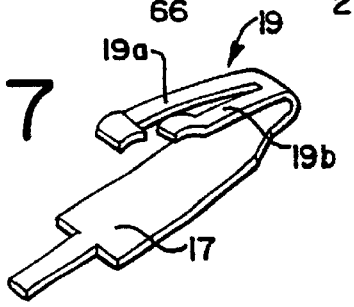
FIG. 7 is a perspective view of a portion of a terminal contact portion of a terminal utilized in the intermediate connector of FIG. 5.
Figure 13:
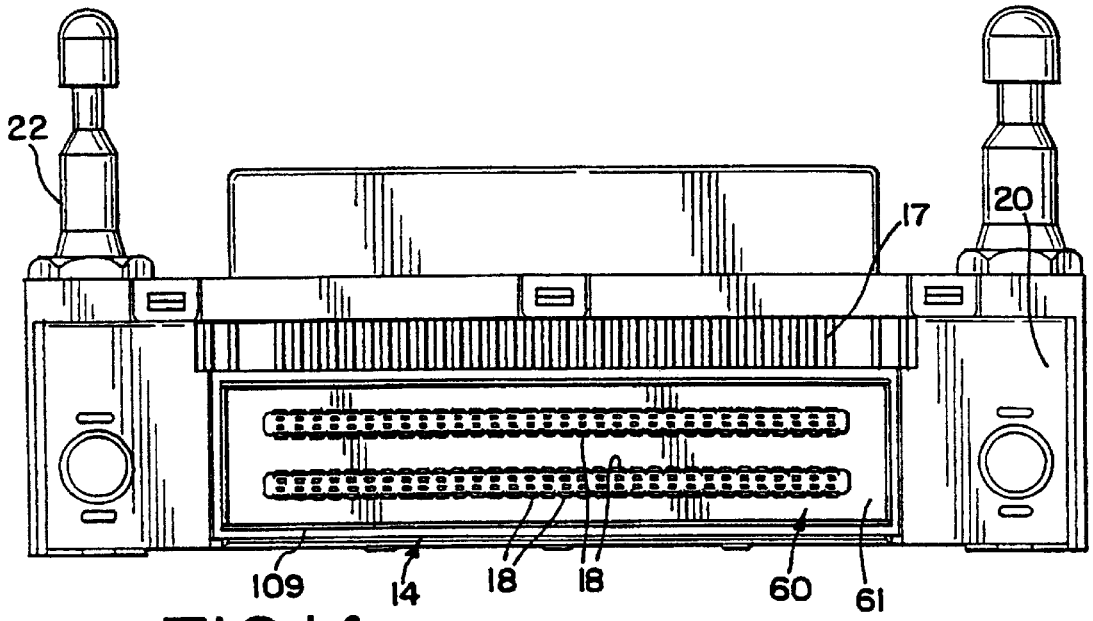
FIG. 13 is a bottom plan view of the intermediate connector of FIG. 5.
Figure 14:
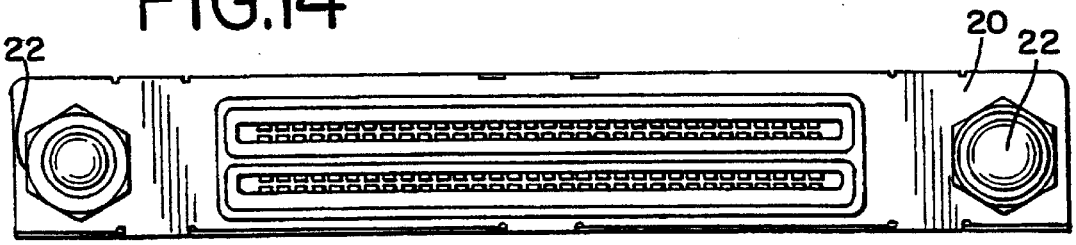
FIG. 14 is a front end view of the intermediate connector of FIG. 5.
Figure 15:
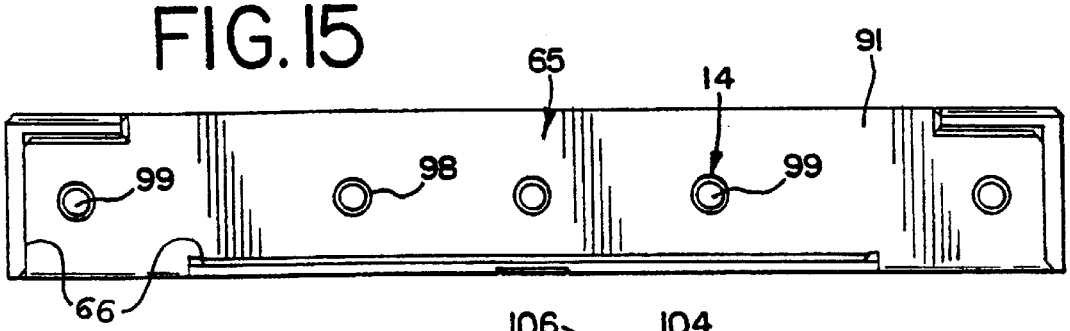
FIG. 15 is a rear end view of the intermediate connector of FIG. 5; and, FIG. 16 is a perspective view of the terminal second contact support portion used in the intermediate connector of FIG. 5, with the terminals removed for clarity.

The housing body 16 of the intermediate connector 6 includes end blocks 20 provided at the opposite ends thereof as shown in FIGS. 1 and 6 and provide a means for mounting the intermediate connectors 6 to the circuit board 2. These end blocks 20 each include, as shown, screw holes 21 passing therethrough in a vertical direction. Each end block has a connector guide pin 22 that faces to the front of the connector housing 16. These guide pins are positioned on opposite sides of the connector housing 16 and are provided for guiding the engagement of the opposing cable connector 4 into engagement with the intermediate connector 6. The guide pins 22 may include, as shown in FIGS. 5, 6 and 13 a round shaft 24 integrally connected to the distal plug end 26 of the shaft 24 by way of a thin neck portion 25. The plug ends 26 may differ in size, with one plug end 26*b* being larger than the other plug end 26*a* to provide a polarizing feature to ensure proper orientation of the cable connector 4 with the intermediate connector 6 and the plug ends may differ in their axial extent, with one being longer than the other.

The intermediate connector 6 us fixed on the circuit board 2 by first engaging it with the upper portion of the surface mount connector 5 in order to complete the surface mount assembly 1. One manner of fixing these intermediate connectors 6 to the surface mount connectors 5 and the circuit board 2 is shown in the middle of FIG. 1. The intermediate connectors 6 are engaged with two corresponding surface mount connectors 5 in a manner such that the whole connector housings 7 of the surface mount connectors 5 are received within the second connector housing 14 of the intermediate connector housing 16. In this manner, the soldering portions of the solder tail portions 11 are also enclosed by the cavity 61 of the second connector housing 14, such that both the surface mount connector housing 7 and the ends (i.e., the soldering portions) of the solder tail portions 11 are covered by the connector housing 16 to avoid exposing them to the exterior environment.

This engagement of the intermediate connector 6 causes the second contact portions 18 of the terminals 17 to respectively engage the opposing contact portions 10 of the surface mount connector terminals 8. Upon engaging, one contact portion 13*a* of the two contact portions 13*a*, 13*b* provided on the contact piece 10 of the surface mount connector 5 wipes the surface of the intermediate connector contact portion 18 and thereby to remove stains or other types of surface contaminants. The pitch of the contact portions 10 and the pitch of the second contact portions 18 are twice the pitch of the solder tail portions 11 of the surface mount connector 5, so that the interval between adjacent contact portions 10, 18 is relatively wide. Therefore, this terminal structure avoids the possibility of shorting adjacent terminals in the connectors.

The intermediate connectors 6 that are engaged with the surface mount connector 5 may be directly fixed on the circuit board 2 by way of screws 28 passing through the screw hole 21 of the end blocks 20 formed at the opposite ends of the connector housing 16 and an opening 27 formed in the printed circuit board 2. By directly fixing the intermediate connector 6 to the circuit board 2, any exterior forces that are applied to the intermediate connector 6 as a result of engaging the cable connector 4 therewith, are directly transferred to the circuit board 2 without being transferred to the surface connector 5. This structure avoids imposing forces on the soldering ends of the solder tail portions 11 of the surface connector 5. The cable connector 4 may be mounted without being interfered by the edge 70 of the circuit board 2 and so facilitate the installation operation.

Upon engaging the cable connector 4 to the intermediate connector 6, the force applied to the intermediate connector 6 from the connector 4 can be directly transferred to one side of the circuit board 2 as set forth above, so that the force applied is not applied to the surface mount connector 5 in order to protect the soldering portions of the solder tail portions 11. By engaging the intermediate connector 6 with the surface connector 5 so that the contact portions 18 of the terminals 17 of the relay connector 6 are interengaged with each other in a one-to-one relationship, the conductive pads (not shown) of the circuit board 2 are placed within the dual row leaf engagement portion 15 of the intermediate connector 6 in the electrically conducting condition.

As shown in FIG. 8, the cable connector 4 is constructed to interengage with the intermediate connector dual row leaf engagement portion 15. The cable connector 4 includes a connector housing 32 loaded with a plurality of terminals 33. The connector housing 32 is covered by a metal shielding cover 34 on the outer upper and lower sides thereof. The connector housing 32 includes an engagement portion 30 formed one end thereof that projects outwardly from the metal cover 34. The metal shell 31 is fitted on the periphery of the engaging portion 30 nd projects exterior thereof.

The terminals 33 of the cable connector 4 are loaded in a parallel arrangement in the connector housing 32 with the same pitch as the pitch P, that of the terminals 8 in the surface mount connector 5. As shown in FIG. 8, the terminals 33 include contact portions 35 located on the upper and lower sides of the engagement portions 30 and respectively engage with two sets of the contact portions 19 of the intermediate connector 6 that are located within the dual row leaf engagement portion 15. Insulation displacement contact portions 36 are formed on the terminals 33 and are located within the connector housing 32. As is known in the art, insulated wires 37 of the cable 3 that lie within the metal cover 34 are terminated to the terminals 33 in a conventional manner by pressing them against the terminals 33. The cable connector 4 includes guide holes (not shown) that the guide pins 22 that project from the intermediate connector 6.

By engaging the cable connector 4 with the intermediate connector 6, the contact portions 19 of the intermediate connector terminals 17 and the contact portions 35 of the cable connector terminals ar engaged together. Release means that include levers 44 are provided on the exterior of the cable connector 4 so as to provide a means for a user to grab and readily disengage the cable connector 4 from the intermediate connector 6.

FIG. 1 illustrates the surface mount connectors 5 mounted on opposite surfaces of the circuit board 2, and with intermediate connectors 6 engaged with the surface mount connectors 5. The intermediate connectors 6 provides on the opposite surfaces of the surface mount connector 5 are fixed on the circuit board 2 by common screws 28. By mounting two such connector assemblies 1 on the opposite surfaces of the circuit board 2, the effective utilization of the opposite surfaces of the circuit board 2 is accomplished. It will be understood that the surface connector 5 may be mounted to only one surface of the circuit board 2 and engaged with one corresponding intermediate connector 6.

The fixing of the intermediate connectors 6 on the circuit board 2 is also not limited to means of mounting screws 28. It is possible to use other fixing means, such as a fixing peg provided on the intermediate connector housing body 16. With the use of screws 28, it is easy to fix and releasably mount the intermediate connector 6 from the surface mount connector 5, which is convenient for replacement and repair. The screws 28 used in FIG. 1 may engage formed openings in the opposite intermediate connector 6 so that two such intermediate connectors 6 mounted on the opposite surfaces of the circuit board may be simultaneously fixed by one common screw 28.

The connector body 16 also includes a spacer member 65 that has a series of slots 80 formed therein that receives portions of the top row of terminals 17. (FIG. 5.) By the use of these three separate housing pieces, a simple connector housing 16 is constructed, with an internal passage 82 that passes through the connector housing 16 and which communicates with both the top and bottom surfaces of the connector 6. It will be understood that the first engagement portion 15 may be fitted onto the terminals 17 at the first contact portions 19, while the second engagement position 14 may be fitted onto the other end of the terminals 17 at second contact portions 18, and from different directions. The spacer 65 serves to keep the terminals 17 in their proper alignment. With this multi-part structure, the need to expensively mold a one-piece connector housing with complex internal passages is avoided and the cast of the connector is reduced.

Figure 10:
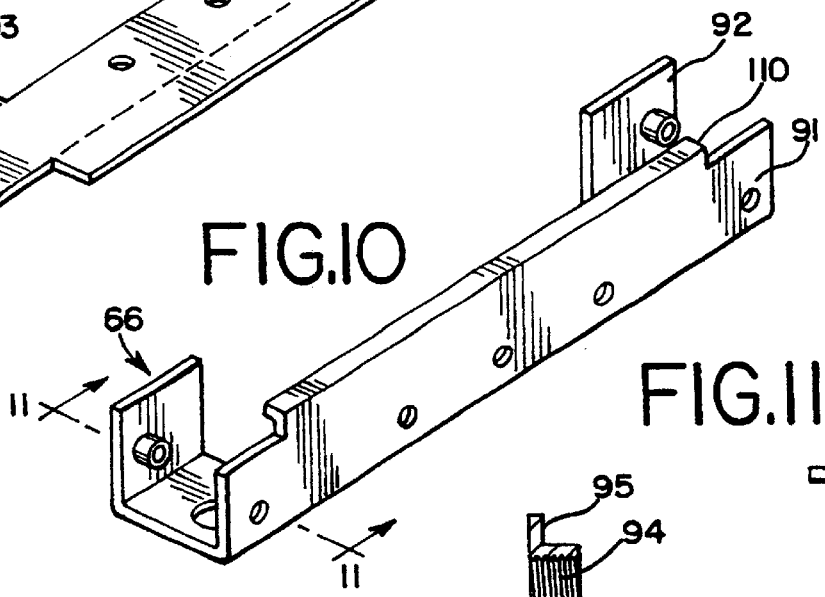
FIG. 10 is the same view as FIG. 9, but with the retention member completely formed.
Figure 11:
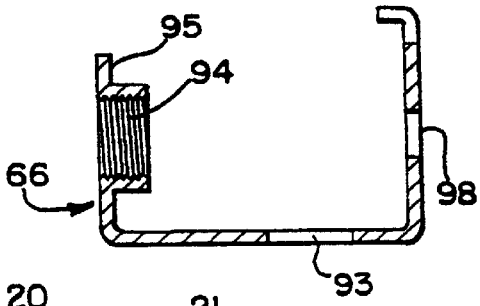
FIG. 11 is a sectional view of the retention member of FIG. 10, taken along lines 11—11 thereof.

In order to maintain the parts of the connector body together, a retainer 66 is provided. This retainer 66 is shown best in FIGS. 10 and 12 and may include a metal clip 90 that is stamped and formed, preferably during insertion into the connector 6. The retainer 66 has a base 91 that extends for approximately the width of the connector 6. The base 91 has two legs 92 that are formed at its ends. These legs 92 includes openings 93 through which the mounting screws 28 may pass. They also include second openings 94 in a portion 95 bent at an angle thereto that are received within the interior of the connector body 16 and which are threaded. These threaded openings 94 engage threaded ends 96 of the guide pins 22. So, it will be understood that the retainer 66 also serves to retain the guide pins 22 in place in connector 6.

Figure 16:
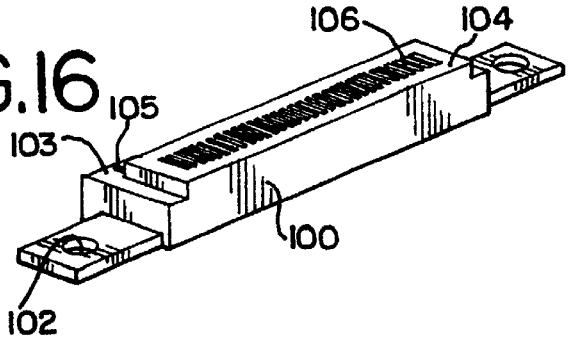

The base 91 of the retainer 65 is also bent in a direction parallel to the ends 95 of the leg portions 92. When bent during the assembly process, holes 98 that are formed in the base 91 will receive and engage alignment studs, or posts 99 that are formed with the second engagement portion 14. This second engagement portion 14 is shown in FIG. 16 and it includes a base 100 having two tabs 101 extending at its sides. These tabs 101 have openings 102 that receive the mounting screws 28. The base 100 further has a "stepped" that presents two different levels 103, 104 for receiving the terminals 17, particularly the second contact portions 18. Each such level has a plurality of slots 105, 106 that are sized to receive the terminals 17. The stepped configuration of the second engagement portion 14 permits the terminals 17 to be contained within the connector body 16.

In assembly of the connector, as might, the leg portions 92 are first formed and inserted into the connector body where they will abut the front wall 106 of the connector 6 that is formed as part of the first engagement portion 15. The base 91 is then bent over the rear wall 109 of the second engagement portion 14, so that the alignment posts will be received within the opening 98 of the retainer 65. A top flange 110 may be then formed as part of a process in which the retainer 65 and the other parts are crimped together.

While the preferred embodiments of the invention have been shown and described, it will be understood by those skilled in the art the changes or modifications may be made thereto without departing from the true spirit and scope of the invention.

What is claimed is:

1. An intermediate connector for providing a connection between a surface mount connector associated with a printed circuit board along and an opposing docking-style connector, the intermediate connector comprising:

a connector body, the connector body including a plurality of conductive terminals disposed therein, said connector body having first and second connector engagement portions disposed on different surfaces of said connector body and at an angle to each other, said second engagement portion defining a plug end of said intermediate connector and said first engagement portion defining a dual row leaf receptacle end of said intermediate connector;

said connector further including distinct first and second terminal support portions respectively disposed at said first and second engagement portions;

the terminals having first and second contact portions disposed at opposite ends of said terminals, said terminal first contact portions being disposed on said first engagement portion and said terminal second contact portions being disposed on said second engagement portion, said first and second engagement portions orienting said terminal first and second contact portions in different directions so as to provide a right angle connection between said surface mount and said opposing connector, said connector further including a separate spacer member and a retainer, the spacer member engaging at least some of said terminals in order to maintain spacing between said terminals, and the retainer holding said spacer member and said second engagement portion together in place within said connector body.

2. The intermediate connector set forth in claim 1, wherein said connector body includes means for directly fixing said intermediate connector to said circuit board in order to resist forces generated during engagement and disengagement of said opposing docking-style connector with said intermediate connector, said direct fixing means including at least one mounting screw and at least one mounting hole formed in said connector body for receiving said mounting screw therethrough, said mounting hole having an axis which is angularly offset from a plane in which said circuit board extends.

3. The intermediate connector set forth in claim 2, wherein said connector body mounting hole is aligned with a corresponding opposing mounting hole formed in said circuit board when said intermediate connector is mated to said surface mount connector.

4. The intermediate connector as set forth in claim 1, wherein said spacer member forms part of a top surface of said intermediate connector and said second engagement portion forms at least part of a bottom surface of said intermediate connector.

5. The intermediate connector as set forth in claim 4, wherein said spacer member abuts part of said second engagement portion.

6. The intermediate connector as set forth in claim 2, further including a retainer for holding said first and second engagement portions together within said connector body, the retainer further including at least one hole formed therein that is aligned with said connector body mounting hole.

7. The intermediate connector as set forth in claim 6, wherein said first engagement portion supports said retainer and said retainer has opposing base and leg portions that hold said first and second engagement portions therebetween.

8. The intermediate connector as set forth in claim 1, further including a pair of guide pins extending on opposite sides of said first engagement portion for guiding said opposing connector into engagement with said intermediate connector, said guide pins, and further including a retainer for holding said first and second engagement portions in place within said connector body, said guide pins engaging said retainer to assist in holding said first and second engagement portions in place within said connector body.

9. The intermediate connector as set forth in claim 8, further including a spacer member that spaces some of said terminals apart from each other, said spacer member being held in place within said connector body by said retainer.

10. The intermediate connector as set forth in claim 8, wherein said guide pins threadedly engage said retainer on opposite sides of said first engagement portion.

11. A connector for providing a connection between a surface mount connector and an opposing connector, the surface mount connector being disposed on a circuit board and positioned near an edge of the circuit board, said surface mount connector being a receptacle style connector having at least one opening formed therein for receiving a portion of said connector therein, the opposing connector being a dual row leaf style connector, said connector comprising:

a connector body having a first engagement end that extends perpendicular to said circuit board and having with at least one plug portion that is matable with said surface mount connector, said connector body further having a second engagement end that extends parallel to said circuit board and at an angle to said plug portion, the second engagement end including a dual row leaf connector portion that extends above said circuit board and projects outwardly past said circuit board edge;

said connector body including a plurality of terminals disposed therein and extending between said connector body first and second engagement ends, said terminals having respective first and second contact portions disposed at opposite ends of said terminals and respectively supported by said connector body first and second engagement portions, said dual row leaf connector portion supporting said terminal second contact portions above said circuit board entirely past said circuit board edge;

said connector body first and second engagement portions being formed from two separate and distinct members that are applied to opposite ends of said terminals to thereby define an open, interior passage within said connector body.

12. The connector of claim 11, further including a retainer for holding said first and second engagement portions in place within said connector body, said retainer including spaced apart legs and base portions, said first and second engagement portions of said connector being interposed therebetween, and connector body including at least two mounting holes formed therein, said retainer including two holes formed therein that are aligned with said connector body mounting holes for receiving mounting members therein.

13. The connector of claim 11, further including a pair of guide pins disposed on opposite sides of said second engagement portion for guiding said opposing connector into engagement with said connector second engagement portion.

14. The connector of claim 11, further including a pair of guide pins disposed on opposite sides of said second engagement portion for guiding said opposing connector into engagement with said connector second engagement portion, said connector further including a retainer for holding said first and second engagement portions in place within said connector body, said guide pins threadedly engaging said retainer to hold said first and second engagement portions in place within said connector body.

15. A surface mount connector assembly for mounting to be printed circuit board near an edge thereof, the surface mount connector assembly extending partially beyond the circuit board edge for a preselected distance and for engaging an opposing connector at a location past said circuit board edge, the connector assembly comprising:

a surface mount connector for mounting on a surface of said circuit board near said circuit board edge, and an intermediate connector engageable with said surface mount connector for providing an engagement portion of said connector assembly that is matable with said opposing connector and that is disposed above said circuit board and has a length that extends past said circuit board edge;

said surface mount connector having an elongated housing with a plurality of conductive terminals arranged thereon, said surface mount connector terminals having associated solder tail portions that extend outwardly from said housing along a bottom surface thereof and which are capable of being soldered to said circuit board along the exterior of said housing, said surface mount connector terminals further having contact portions that line opposing sides of a receptacle formed in said housing;

said intermediate connector including an elongated intermediate connector body formed from first and second parts, and further having a first engagement end with at least one plug portion that is insertable into said surface mount connector receptacle, said intermediate connector body further having a second engagement end that extends parallel to said circuit board and at an angle to said surface mount connector receptacle, the second engagement end including a dual row leaf connector portion that extends above said circuit board and projects outwardly past said circuit board edge, and a plurality of terminals extending between said intermediate connector first and second engagement end said intermediate connector further including a retainer for holding said first and second parts together; and, means for fixing said intermediate connector directly to said circuit board in order to prevent forces generated during engagement and disengagement of said opposing connector with said connector assembly from detrimentally affecting said surface mount connector solder tail portions, said fixing means including a pair of mounting holes disposed in said intermediate connector body at opposite ends of said intermediate connector and a pair of mounting holes disposed in said retainer, and a pair of mounting screws that are received within said mounting holes and within mounting holes formed in said circuit board when said connector assembly is mounted to said circuit board.

16. The surface mount assembly of claim 15, wherein said intermediate connector terminals include first and second contact portions respectively disposed at said first and second engagement ends of said intermediate connector, said second contact portions being supported by said dual row leaf connector portion above said circuit board entirely past said circuit board edge.

17. An intermediate connector for providing a connection between a surface mount connector associated with a printed circuit board along and an opposing docking-style connector, the intermediate connector comprising:

a connector body, the connector body including a plurality of conductive terminals disposed therein, said connector body having first and second connector engagement portions disposed on different surfaces of said connector body and at an angle to each other, said second engagement portion defining a plug end of said intermediate connector and said first engagement portion defining a dual row leaf receptacle end of said intermediate connector;

said connector further including distinct first and second terminal support portions respectively disposed at said first and second engagement portions;

the terminals having first and second contact portions disposed at opposite ends of said terminals, said terminal first contact portions being disposed on said first engagement portion and said terminal second contact portions being disposed on said second engagement portion, said first and second engagement portions orienting said terminal first and second contact portions in different directions so as to provide a right-angle connection between said surface mount connector and said opposing connector;

said connector body including at least one mounting member for fixing said intermediate connector directly to said circuit board, and at least one mounting hole formed in said connector body for receiving said mounting member therethrough; and, a retainer for holding said first and second engagement portions together within said connector body, the retainer including at least one opening formed therein which is aligned with said connector body mounting hole.

* * * * *